US008590635B2

(12) United States Patent
Koederitz

(10) Patent No.: US 8,590,635 B2
(45) Date of Patent: Nov. 26, 2013

(54) METHOD AND APPARATUS FOR AUTOMATED DRILLING OF A BOREHOLE IN A SUBSURFACE FORMATION

(75) Inventor: William Leo Koederitz, Cedar Park, TX (US)

(73) Assignee: National Oilwell Varco, L.P., Houston, TX (US)

( * ) Notice: Subject to any disclaimer, the term of this patent is extended or adjusted under 35 U.S.C. 154(b) by 411 days.

(21) Appl. No.: 12/961,663

(22) Filed: Dec. 7, 2010

(65) Prior Publication Data

US 2012/0138362 A1 Jun. 7, 2012

(51) Int. Cl.
*E21B 44/00* (2006.01)

(52) U.S. Cl.
USPC ..... 175/24; 175/26; 175/27

(58) Field of Classification Search
USPC ..... 175/24, 26, 27, 40
See application file for complete search history.

(56) References Cited

U.S. PATENT DOCUMENTS

| | | | | |
|---|---|---|---|---|
| 6,026,912 | A | 2/2000 | King et al. | |
| 7,198,117 | B2 * | 4/2007 | Uitto | 175/27 |
| 2006/0162962 | A1 | 7/2006 | Koederitz et al. | |
| 2008/0156531 | A1 | 7/2008 | Boone et al. | |
| 2009/0090555 | A1 | 4/2009 | Boone et al. | |
| 2012/0123756 | A1 * | 5/2012 | Wang et al. | 703/2 |

OTHER PUBLICATIONS

Dupriest, Fred E. and William L. Koederitz, Maximizing Drill Rates with Real-Time Surveillance of Mechanical Specific Energy, presented at the SPE/IADC Drilling Conference, held in Amsterdam, The Netherlands, Feb. 23-25, 2005, SPE/IADC 92194.

Fertl, W.H., G.V. Chilingar, and J.O. Robertson Jr., Chapter 6 Drilling Parameters, Developments in Petroleum Science, vol. 50, 2002, pp. 151-167.

Koederitz, William L. and Jeff Weis, A Real-time Implementation of MSE, presented at the AADE 2005 National Technical Conference and Exhibition, held at the Wyndam Greenspoint in Houston, Texas, Apr. 5-7, 2005, AADE-05-NTCE-66.

Teale, R., The Concept of Specific Energy in Rock Drilling, Int. J. Rock Mech. Mining Sci. vol. 2, pp. 57-73, Pergamon Press 1965.

Young, Jr., F.S., Computerized drilling control, Journal of Petroleum Technology, vol. 21, No. 4, Apr. 1969, pp. 483-496.

* cited by examiner

*Primary Examiner* — Giovanna Wright
*Assistant Examiner* — Richard Alker
(74) *Attorney, Agent, or Firm* — Conley Rose, P.C.

(57) ABSTRACT

A method for automated drilling of a borehole in a subsurface formation includes drilling the borehole using a set of drilling control variables assigned a set of values. An automated drilling index of the drilling is monitored. The automated drilling index of the drilling is a combination of a first index that depends on a rate of penetration of the drilling and a second index that depends on a mechanical specific energy of the drilling. The values assigned to the set of drilling control variables are selectively adjusted at least once during the drilling based on the monitoring of the automated drilling index.

23 Claims, 5 Drawing Sheets

METHOD AND APPARATUS FOR AUTOMATED DRILLING OF A BOREHOLE IN A SUBSURFACE FORMATION

BACKGROUND

1. Technical Field

The invention relates to automated monitoring and control of a drilling operation carried out in a borehole.

2. Description of Related Art

Rate of penetration (ROP) of a drilling process is the speed at which a bit drills through a subsurface formation to increase the reach of a borehole in the subsurface formation during the drilling process. Automated drilling based on optimizing ROP is known in the art. For example, U.S. Pat. No. 6,026,912 (King et al.; 22 Feb. 2000) describes a method and system for optimizing ROP in drilling operations. In the King et al. patent, an optimum weight-on-bit (WOB) necessary to achieve an optimum ROP is continuously determined, and weight is maintained on the bit at the optimum WOB during drilling.

Mechanical specific energy (MSE) of a drilling process is a measure of the efficiency of the drilling process. Automated drilling based on optimizing MSE is known in the art. For example, U.S. Patent Application Publication No. 2008/0156531 (Boone et al., 3 Jul. 2008) describes methods and apparatus for automated drilling based on MSE. In the Boone et al. publication, the methods include sequentially varying WOB and bit rotational speed (RPM) to find a desired MSE. Desirability of an MSE is based on comparing the MSE to a baseline MSE. If the MSE is substantially equal to or less than the baseline MSE, then the MSE is desirable relative to the baseline MSE. U.S. Patent Application Publication No. 2006/0162962 (Koederitz et al.; 27 Jul. 2006) describes monitoring MSE during drilling and using the MSE to detect onset of abnormal events during drilling.

SUMMARY

In one aspect of the invention, a method for automated drilling of a borehole in a subsurface formation comprises drilling the borehole using a set of drilling control variables assigned a set of values (step a), monitoring an automated drilling index of the drilling of step a (step b), where the automated drilling index of the drilling of step a is a combination of a first index dependent on a rate of penetration of the drilling of step a and a second index dependent on a mechanical specific energy of the drilling of step a, and selectively adjusting the set of values of step a at least once during step a based on the monitoring of step b (step c).

In another aspect of the invention, a method for automated drilling of a borehole in a subsurface formation comprises defining an automated drilling index as a combination of a rate of penetration index and a mechanical specific energy index (step a), defining a set of drilling control variables (step b), selecting a set of first values for the set of drilling control variables (step c), assigning the set of first values to the set of drilling control variables (step d), drilling through one interval of the borehole using the set of drilling control variables assigned the set of first values (step e), determining a first value of the automated drilling index corresponding to the drilling of step e (step f), assigning a set of second values to the set of drilling control variables (step g), drilling through another interval of the borehole using the set of drilling control variables assigned the set of second values (step h), determining a second value of the automated drilling index corresponding to the drilling of step h (step i), assigning a set of third values to the set of drilling control variables based on a comparison between the first value of the automated drilling index and the second value of the automated drilling index (step j), and updating the set of first values with the set of third values and repeating step d (step k).

In another aspect of the invention, a program product comprises a computer-readable media having recorded thereon computer-executable instructions for automated drilling of a borehole in a subsurface formation, where the computer-executable instructions perform controlling drilling of a first interval of the borehole using a set of drilling control variables assigned a set of first values (step a), determining of a first value of an automated drilling index corresponding to drilling of the first interval of the borehole, the automated drilling index being defined as a combination of a rate of penetration index and a rate of mechanical specific energy index (step b), controlling drilling of a second interval of the borehole using the set of drilling control variables assigned a set of second values (step c), determining of a second value of the automated drilling index corresponding to the drilling of the second interval of the borehole (step d), and controlling drilling of a third interval of the borehole using the set of drilling control variables assigned a set of third values selected based on a comparison between the first and second values of the automated drilling index (step e).

In another aspect of the invention, a program product comprises a computer-readable media having recorded thereon computer-executable instructions for automated drilling of a borehole in a subsurface formation, where the computer-executable instructions perform outputting of a set of drilling control variables assigned a set of first values to a drilling apparatus adapted to drill the borehole in the subsurface formation (step a), determining of a first value of an automated drilling index based on a first drilling process variable measurement made during drilling of the borehole using the set of drilling control variables assigned the set of first values, the automated drilling index being defined as a combination of a rate of penetration index and a rate of mechanical specific energy index (step b), outputting of the set of drilling control variables assigned a set of second values to the drilling apparatus (step c), determining of a second value of the automated drilling index based on a second drilling process variable measurement made during drilling of the borehole using the set of drilling control variables assigned the set of second values (step d), and assigning of a set of third values to the set of drilling control variables based on a comparison between the first and second values of the automated drilling index and outputting the set of drilling control variables assigned the set of third values to the drilling apparatus (step e).

In another aspect of the invention, an apparatus for automated drilling of a borehole in a subsurface formation comprises means for drilling the borehole using a set of drilling control variables assigned a set of values and means for measuring a set of drilling process variables during drilling of the borehole. The apparatus further comprises means for determining an automated drilling index of the drilling of the borehole from the measuring of the set of drilling process variables, where the automated drilling index is a combination of a first index that depends on a rate of penetration of the drilling and a second index that depends on a mechanical specific energy of the drilling. The apparatus further comprises means for comparing different values of the automated drilling index and adjusting the set of values assigned to the set of drilling control variables used in the drilling of the borehole based on a result of the comparing.

It is to be understood that both the foregoing summary and the following detailed description are exemplary of the invention and are intended to provide an overview or framework for understanding the nature and character of the invention as it is claimed. The accompanying drawings are included to provide a further understanding of the invention and are incorporated in and constitute a part of this specification. The drawings illustrate various embodiments of the invention and together with the description serve to explain the principles and operation of the invention.

BRIEF DESCRIPTION OF DRAWINGS

The following is a description of the figures in the accompanying drawings. The figures are not necessarily to scale, and certain features and certain views of the figures may be shown exaggerated in scale or in schematic in the interest of clarity and conciseness.

DETAILED DESCRIPTION

Additional features and advantages of the invention will be set forth in the detailed description that follows and, in part, will be readily apparent to those skilled in the art from that description or recognized by practicing the invention as described herein.

Figure 1:
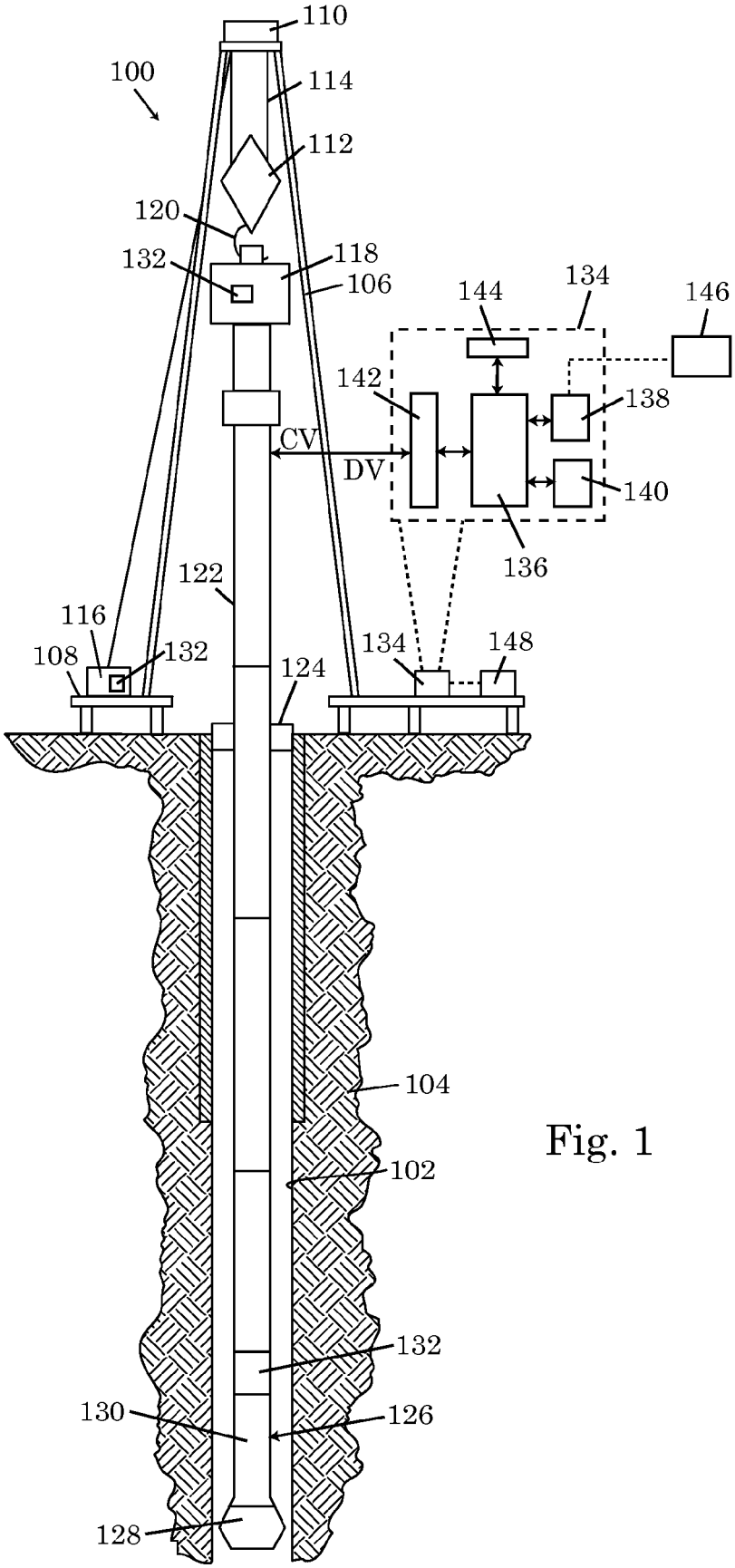
FIG. 1 is a schematic of an apparatus for automated drilling of a borehole in a subsurface formation.

In one embodiment of the invention, as illustrated in FIG. 1, an apparatus 100 for automated drilling of a borehole 102 in a subsurface formation 104 includes a derrick 106 on a rig floor 108. A crown block 110 is mounted at the top of the derrick 106, and a traveling block 112 hangs from the crown block 110 by means of a cable or drilling line 114. One end of the cable or drilling line 114 is connected to drawworks 116, which is a reeling device operable to adjust the length of the cable or drilling line 114 so that the traveling block 112 moves up and down the derrick 106. A top drive 118 is supported on a hook 120 attached to the bottom of the traveling block 112. The top drive 118 is coupled to the top of a drill string 122, which extends through a wellhead 124 into the borehole 102 below the rig floor 108. The top drive 118 is used to rotate the drill string 122 inside the borehole 102 as the borehole 102 is being drilled in the subsurface formation 104. A bottomhole assembly 126 is provided at the bottom of the drill string 122. The bottomhole assembly 126 includes a bit 128 and a downhole motor 130 and may include other components not specifically identified but known in the art, e.g., a sensor package.

Although not shown, the automated drilling apparatus 100 includes a mud tank, which contains drilling fluid or "mud," a mud pump for transferring the drilling fluid to a mud hose, and a mud treatment system for cleaning the drilling fluid when it is laden with subsurface formation cuttings. The mud hose, in use, would be fluidly connected to the drill string so that the drilling fluid can be pumped from the mud tank into the drill string. The drilling fluid would be returned to the mud treatment system via a return path between the borehole and the drill string or inside the drill string, i.e., if the drill string is a dual-bore drill string. After the drilling fluid is cleaned in the mud treatment system, the clean drilling fluid would be returned to the mud tank. The details of the fluid circulation system are not shown in the drawing of FIG. 1 because these details are known in the art and do not constitute a novel or inventive aspect of the invention.

In one embodiment of the invention, the automated drilling apparatus 100 includes sensors (or instruments) 132 for measuring drilling process variables. Herein, a drilling process variable is a feature of a drilling process that may change during the drilling process. A variety of drilling process variables may be measured by the sensors 132. The locations of the sensors in the automated drilling apparatus 100 and the types of sensors 132 will be determined by the drilling process variables to be measured by the sensors 132. Examples of drilling process variables that may be measured by the sensors 132 include, but are not limited to, weight on bit, bit or drill string rotational speed, drill string rotational torque, rate of penetration, bit diameter, and drilling fluid flow rate. The exemplary drilling process variables that may be measured by the sensors 132 are useful in calculating MSE, as defined, for example, in Equation (9) below. Measuring of drilling process variables may be direct or indirect. In the indirect measurement, the desired drilling process variable is derived from other measurable drilling process variables. The drilling process variables may be measured at the surface and/or in the borehole. For example, drill string rotational torque may be measured at the surface using a sensor 132 on the top drive 118. Alternatively, pressure differential across the downhole motor 130 may be measured using a sensor 132 downhole, and the drill string rotational torque may be derived from the pressure differential. In another example, the load on hook 120 may be measured using any suitable means at the surface, and weight on bit may be inferred from the hook load. Various other drilling process variables not specifically mentioned above may be measured, or derived, as required by the drilling process.

In one embodiment, the automated drilling apparatus 100 includes one or more drilling controllers, such as drilling controller 134. In one embodiment, the drilling controller 134 includes a processor 136, memory 138, a display 140, a communications interface (or device(s)) 142, and an input interface (or device(s)) 144. The drilling controller 134 receives input from a user via the input interface 144. The drilling controller 134 can send drilling control variables (CV) with assigned values to the components of the automated drilling apparatus 100 via the communications interface 142. The drilling controller 134 can receive measurement of drilling process variables (DV) from the various sensors 132 of the automated drilling apparatus 100 via the communications interface 142. Information related to operation of the drilling controller 134 may be presented on the display 140. The drilling controller logic may be loaded in the memory 138, or stored in some other computer-readable media 146 for subsequent loading into the memory 138. The processor 142 processes the drilling controller logic in memory 138 and interacts with the other components of the drilling controller 134. Although the drilling controller 134 is shown primarily at the surface in FIG. 1, it should be noted that in other embodiments of the invention a portion or all of the drilling controller 134 may be located downhole. For example, the drilling controller logic responsible for receiving and processing sensor data may be located downhole near where the sensor data is collected.

The drilling controller 134 includes or is provided with a set of drilling control variables (CV). A set of drilling control variables includes one or more drilling control variables. Each drilling control variable has a numerical value that indicates a control set-point for a component of the drilling apparatus 100. The components of the drilling apparatus 100 of interest are those that can be controlled via control set-points contained in the set of drilling control variables. The drilling controller 134 sends the values of the drilling control variables to the appropriate drilling apparatus components via the communications interface 142. For example, the drilling controller 134 can send a control set-point, i.e., a value of a drilling control variable, to the top drive 118 that indicates an amount of drill string torsional torque to be outputted by the top drive 118. A feedback loop may be provided between the drilling apparatus components and the drilling controller 134 so that the drilling controller 134 can monitor variations in the outputs of the drilling apparatus components. For example, if a control set-point to the top drive 118 indicates that drill string torsional torque should be set at some value T, the top drive 118 may actually output anywhere from $T-\alpha$ to $T+\alpha$, where a is the variation in the output. The drilling controller 134 may collect information about such variations for later use, e.g., in processing information collected during a drilling process.

In one embodiment, the automated drilling apparatus 100 includes one or more automated drilling index generators, such as automated drilling index generator 148. In one embodiment, the automated drilling index generator 148 includes logic for computing automated drilling index, the nature of which will be further described below. The automated drilling index generator logic may be stored on a computer-readable media, such as or similar to computer-readable media 146. The automated drilling index generator 148 may be separate from the drilling controller 134 or may be integrated with the drilling controller 134. Where the automated drilling index generator is separate from the controller 134, it may include or be associated with a processor and memory for executing the automated drilling index generator logic, a communications interface for communicating with the drilling controller, and an input interface for receiving input from a user (i.e., the automated drilling index generator 148 may have a structure similar to that of the drilling controller 134, except for the underlying logic). Where the automated drilling index generator 148 is integrated with the drilling controller 134, the automated drilling index generator logic may reside in the memory 138, or in some other computer-readable media 146 for subsequent loading into the memory. In this case, the processor 142 would execute the automated drilling index generator logic. In cases where at least a portion of the drilling controller 134 is located downhole, a portion or all of the automated drilling index generator 148 may also be located downhole.

In one embodiment, a set of drilling control variables is defined for a drilling process. Then, the set of drilling control variables is assigned a set of first values. The drilling controller 134 may choose the set of first values. Alternatively, a user or other entity separate from the drilling controller 134 may choose the set of first values. The set of drilling control variables with the set of first values is used to control drilling of a first interval of a borehole in a subsurface formation. A first ROP and a first MSE corresponding to the drilling of the first interval of the borehole are determined from measurements of drilling process variables made during the drilling of the first interval of the borehole. The drilling controller 134 may determine the first ROP and first MSE from the measurement data, or a user or other entity separate from the drilling controller 134 could determine the first ROP and first MSE from the measurement data. The drilling controller 134 provides the first ROP and the first MSE to the automated drilling index generator 148, and the automated drilling index generator 148 returns a first value of an automated drilling index to the drilling controller 134. Then, the set of drilling control variables is assigned a set of second values. As indicated earlier, the drilling controller 134 may choose the set of second values, or a user or other entity separate from the drilling controller 134 may choose the set of second values. The set of drilling control variables with the set of second values is used to control drilling of a second interval of the borehole in the subsurface formation. A second ROP and a second MSE corresponding to the drilling of the second interval of the borehole is determined from measurements of drilling process variables made during the drilling of the second interval of the borehole. The drilling controller 134 provides the second ROP and the second MSE to the automated drilling index generator 148, and the automated drilling index generator 148 returns a second value of an automated drilling index to the drilling controller 134.

For drilling of a third interval of the borehole, the drilling controller 134 then has to decide whether to output the set of drilling control variables with the set of first values or the set of drilling control variables with the set of second values to the components of the automated drilling apparatus 100. This decision may also be made by a user or other entity separate from the drilling controller 134. The decision is based on a comparison between the first and second values of the automated drilling index. In an embodiment, the automated drilling optimization problem is defined as a maximization problem, and the set of drilling control variables with the set of values corresponding to the larger value of the automated drilling index is outputted to the components of the automated drilling apparatus. In another embodiment, the automated drilling optimization problem is defined as a minimization problem, and the set of drilling control variables with the set of values corresponding to the smaller value of the automated drilling index is outputted to the components of the automated drilling apparatus. This process of interrogating the automated drilling index generator 148 for values of the automated drilling index and outputting a set of drilling control variables with a set of values to the automated drilling apparatus 100 based on a comparison of different values of the automated drilling index can be repeated multiple times during drilling of a borehole, as will be further described below. In certain cases, some or all of the calculation of the values of the automated drilling index may be performed by a user or other entity separate from the automated drilling index generator 148.

Figure 2:
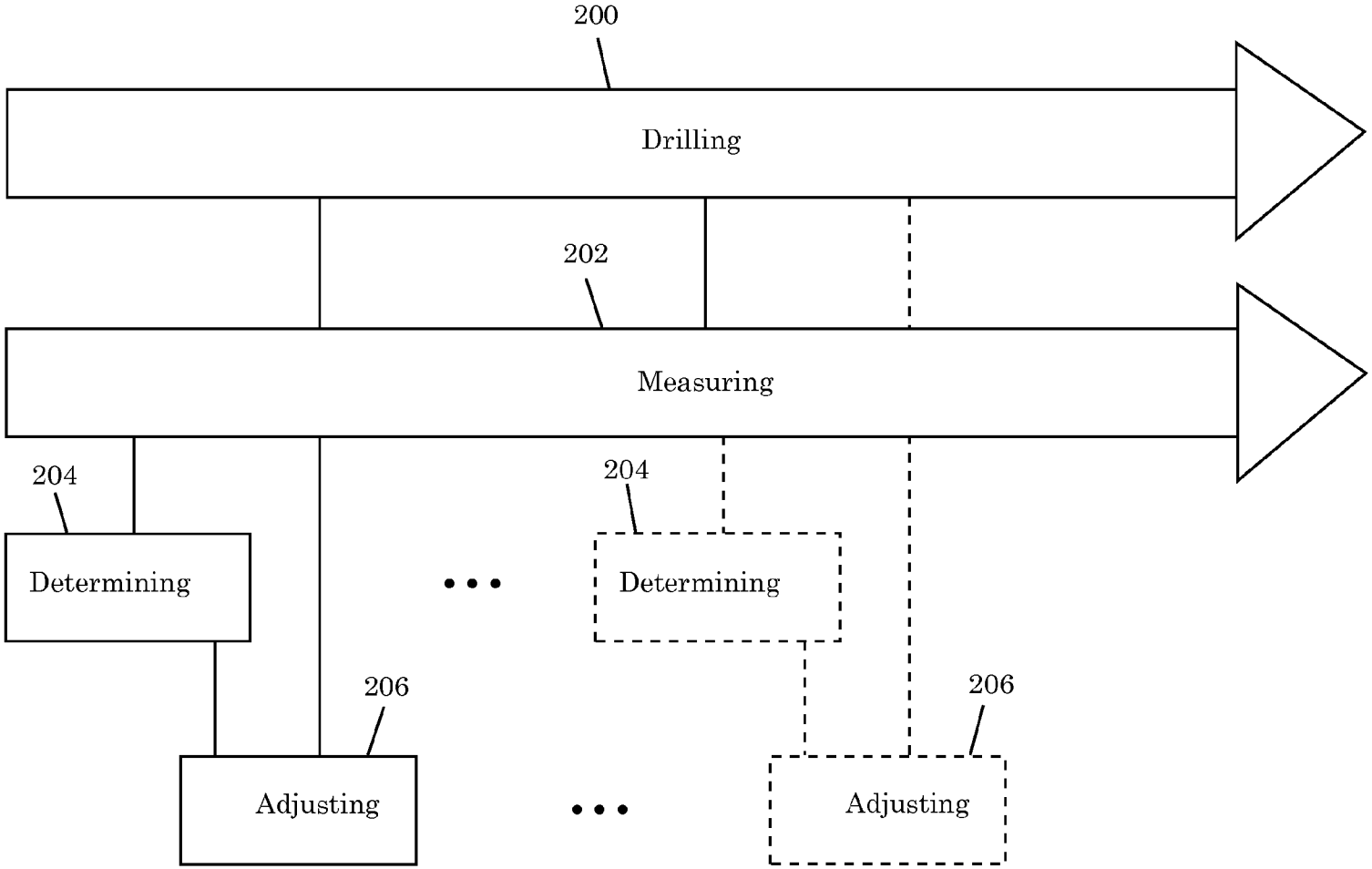
FIG. 2 is a graphical illustration of a method for automated drilling of a borehole in a subsurface formation.

In one embodiment of the invention, as illustrated in FIG. 2, a method for automated drilling of a borehole in a subsurface formation includes, at 200, drilling at least one interval of the borehole (e.g., 102 in FIG. 1) while controlling the drilling using a set of drilling control variables with a set of selected values. The drilling controller (134 in FIG. 1) sends the set of drilling control variables with the set of selected values to various components of the automated drilling apparatus, which then execute various portions of the drilling process according to the set-points specified in the set of selected values. Drilling here includes any form of working the subsurface formation to increase the reach of the borehole in the subsurface formation. Typically, relative to FIG. 1, drilling is accompanied by adjusting the position of the top drive 118 to move the drill string 122 relative to the borehole 102, rotating the drill string 122 relative to the borehole 102 using the top drive 118, possibly rotating the bit 128 separately from rotating the drill string 122, where the bit 128 cuts through the subsurface formation 104 as the bit 128 or the drill string 122 is rotated. Also, drilling fluid or mud is circulated through the drill string 122 and borehole 102, as previously explained. While drilling, the method of FIG. 2 includes, at 202, measuring drilling process variables. In one embodiment, the measurements are provided to the drilling controller 134 of the automated drilling apparatus 100.

The method further includes, at 204, determining a value of an automated drilling index of the drilling based on the measurements of the drilling process variables. How to determine the value of the automated drilling index will be described in detail below. Briefly, the automated drilling index is a combination of an index whose value depends on ROP and an index whose value depends on MSE. The ROP and MSE indices are combined in the automated drilling index such that both ROP and MSE benefit, i.e., are optimized, when the automated drilling index is maximized or minimized. Whether the automated drilling index is maximized or minimized in a drilling process will depend on how ROP and MSE indices are defined and combined. One or more examples of how ROP and MSE indices are defined and combined will be described below. The method includes, at 206, adjusting the set of selected values of the set of drilling control variables being used to control the drilling at 200. This involves determining the adjustments to be made to the set of selected values, adjusting the set of selected values as planned, and transmitting the set of drilling control variables with the adjusted set of selected values to components of the drilling apparatus so that the drilling at 200 can be controlled by the set of drilling control variables and the adjusted set of selected values. Determination of adjustments to be made to the set of selected values may be automatic, e.g., according to the drilling controller logic, or involve user or other entitative intervention either at the drilling site or at a remote site. As the values of the drilling control variables change, so will the values of the drilling process variables involved in the drilling at 200, so will the results of the measuring at 202.

Determining adjustments to the set of selected values at 204 and adjusting the set of selected values at 206 are repeated until the automated drilling index is maximized or minimized, depending on how the automated drilling index is defined. In general, the automated drilling index will have an upper limit and a lower limit so that the meaning of the automated drilling index being maximized or minimized is not ambiguous. Maximizing automated drilling index would entail adjusting the set of selected values for the set of drilling control variables used in controlling the drilling at 200 so that the corresponding value of the automated drilling index determined at 204 is brought as close as possible to the automated drilling index upper limit, while minimizing automated drilling index would entail adjusting the set of selected values for the set of drilling control variables used in controlling the drilling at 200 so that the corresponding value of the automated drilling index determined at 204 is brought as close as possible to the automated drilling index lower limit.

In one embodiment, an automated drilling index is considered to be maximized if it is in a range from 80% to 100% of the automated drilling index upper limit or considered to be minimized if it is in a range from 100% to 120% of the automated drilling index lower limit. In another embodiment, an automated drilling index is considered to be maximized if it is in a range from 90% to 100% of the automated drilling index upper limit or considered to be minimized if it is in a range from 100% to 110% of the automated drilling index lower limit. In yet another embodiment, automated drilling index is considered to be maximized if it is in a range from 95% to 100% of the automated drilling index upper limit or considered to be minimized if it is in a range from 100% to 105% of the automated drilling index lower limit. When it is determined that the automated drilling index is maximized or minimized, the determining process at 204 and the adjusting process at 206 may cease. This ceasing may or may not coincide with the end of drilling at 200 and measuring at 202.

Notice that FIG. 2 is not a simple flowchart where a first step is started and completed, then a second step is started and completed, etc. In FIG. 2, drilling at 200, measuring at 202, determining at 204, and adjusting at 206 are overlapping and interdependent processes. Drilling at 200 and measuring at 202 occur over a long period, typically side-by-side. Determining at 204 and adjusting at 206 occur at various times during drilling at 200 and measuring at 202. Measuring at 202 depends on drilling at 200, determining at 204 depends on measuring at 202, and adjusting at 206 depends on determining at 204. A more sequential flow of the method of automated drilling of a borehole will be described below with reference to FIG. 3*a*.

Figure 3A:
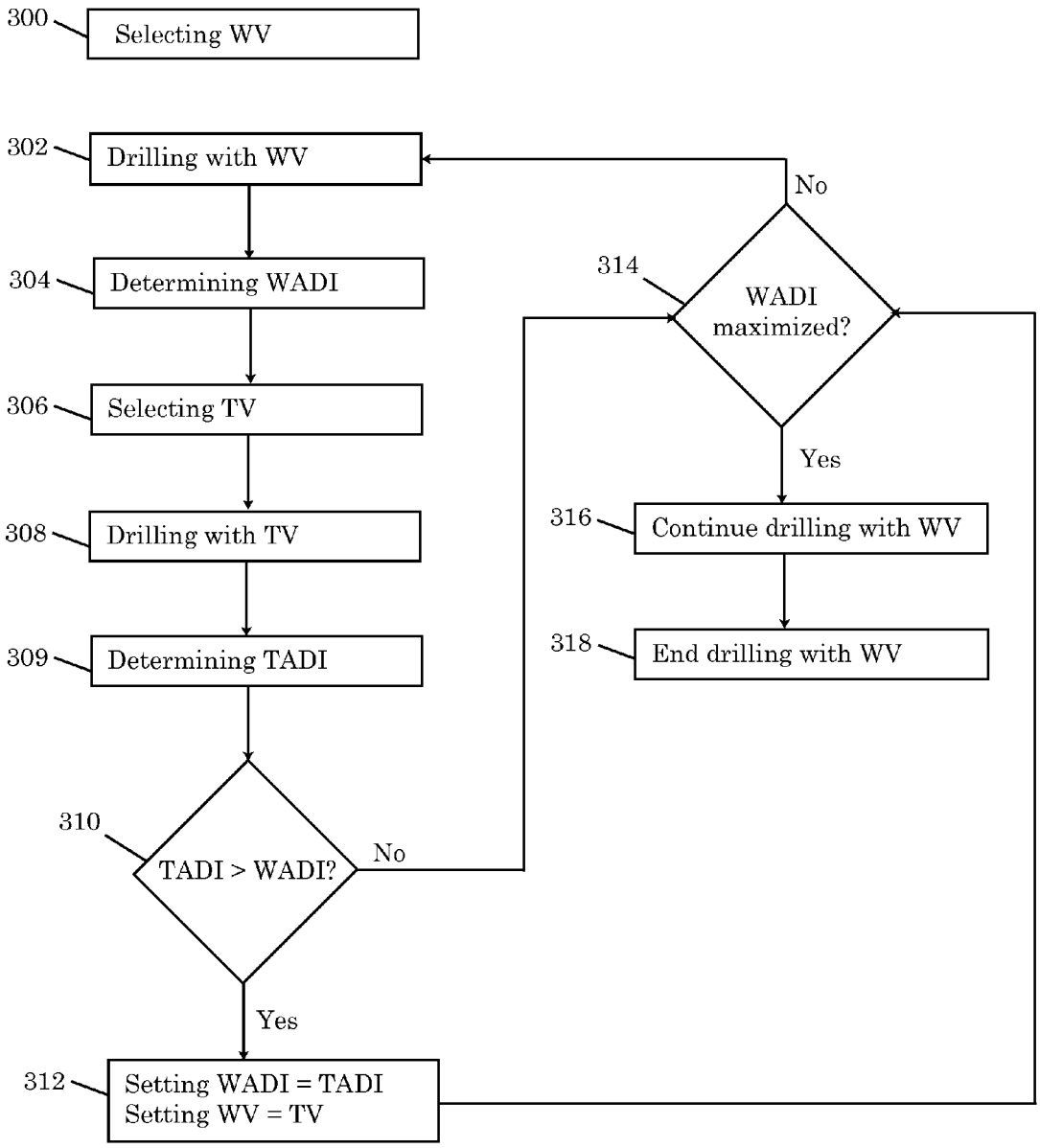
FIG. 3*a* is a flowchart illustrating a method for automated drilling of a borehole in a subsurface formation.

In one embodiment of the invention, as illustrated in FIG. 3*a*, a method of automated drilling of a borehole includes, at 300, selecting a set of working values (WV) for a set of drilling control variables. The set of drilling control variables is defined based on the drilling process to be controlled by the set of drilling control variables. The set of working values may be auto-generated by the drilling controller logic or provided to the drilling controller logic by a user or other entity separate from the drilling controller logic. The method includes, at 302, drilling the borehole (e.g., 102 in FIG. 1) using the set of drilling control variables with the set of working values. In step 302, the drilling controller (134 in FIG. 1) provides the set of drilling control variables with the set of working values to the automated drilling apparatus, which then controls drilling of the borehole using the set-points specified in the set of working values. The method includes, at 304, determining a working value of the automated drilling index (WADI) corresponding to the set of drilling control variables with the set of working values. In step 304, measurements of drilling process variables are made while the drilling of the borehole is being controlled by the set of drilling control variables with the set of working values, and WADI is determined from the measurements. The automated drilling index generator (148 in FIG. 1) receives the necessary information for determining WADI from the drilling controller (134 in FIG. 1) and makes the necessary working automated drilling index calculations. Although, as previous noted, it is quite possible for a user or other entity separate from the automated drilling index generator to make the determination of WADI.

The method includes, at 306, selecting a set of test values (TV) for the set of drilling control variables. In step 306, the set of test values may be auto-generated by the drilling controller logic or provided to the drilling controller logic by a user or other entity separate from the drilling controller. The method includes, at 308, drilling the borehole using the set of drilling control variables with the set of test values. In this step, the drilling controller (134 in FIG. 1) provides the set of drilling control variables with the set of test values to the automated drilling apparatus (100 in FIG. 1), which then controls drilling of the borehole (e.g., 102 in FIG. 1) using the set-points specified in the set of test values. The method includes, at 309, determining a test value of the automated drilling index (TADI) corresponding to the set of drilling control variables with the set of test values. In step 309, measurements of drilling process variables are made while the drilling of the borehole is being controlled by the set of drilling control variables with the set of test values, and TADI is determined from the measurements. The automated drilling index generator (148 in FIG. 1) receives the necessary information for determining TADI from the drilling controller (134 in FIG. 1) and makes the necessary automated drilling index calculations. Although, as previously noted, it is quite possible for a user or other entity separate from the automated drilling index generator to make the determination of TADI.

The method includes, at 310, comparing the test value of the automated drilling index (TADI) to the working value of the automated drilling index (WADI). For a maximization problem, the method includes, at 312, updating the set of working values (WV) with the set of test values (TV), i.e., WV=TV, and updating the working value of the automated drilling index (WADI) with the test value of the automated drilling index (TADI), i.e., WADI=TADI, if the test value of the automated drilling index is larger than the working value of the automated drilling index. The method includes, at 314, checking whether WADI is maximized. If WADI is not maximized, the method includes repeating the processes or steps indicated at 302, 304, 306, 308, 309, 310, 312, and 314. If WADI is maximized, drilling simply continues, at 316, with the set of drilling control variables and set of working values. At some point, drilling is terminated 318. During drilling 316, periodic checks may be made to ensure that WADI is still maximized. If during drilling at 316 WADI is not maximized, the processes or steps indicated at 302, 304, 306, 308, 309, 310, 312, and 314 may be repeated again. Notice that the method of FIG. 3*a* is consistent with the method of FIG. 2.

Figure 3B:
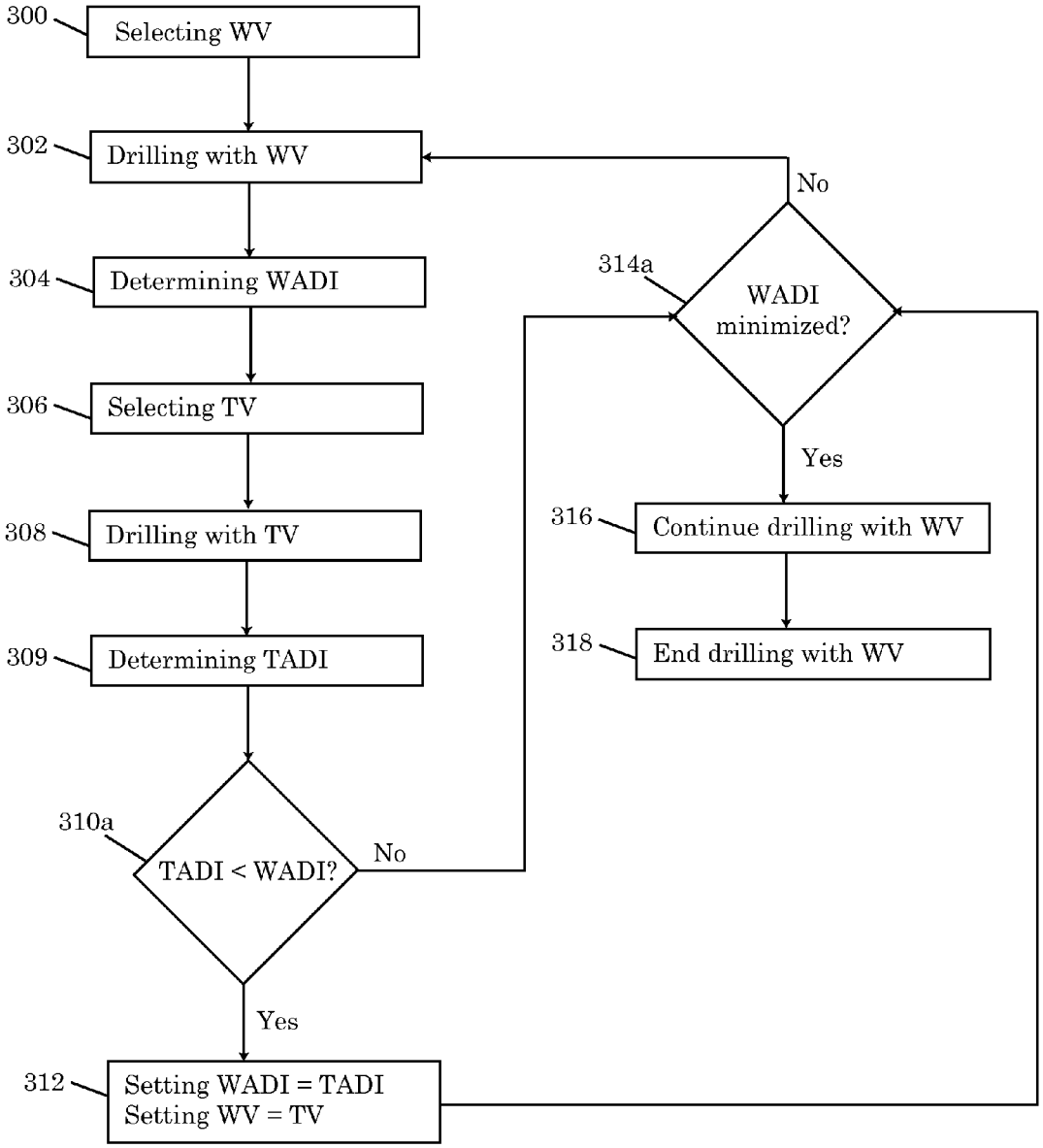
FIG. 3*b* is a flowchart illustrating a method for automated drilling of a borehole in a subsurface formation.

The flowchart of FIG. 3*a* may be adapted for a minimization problem, as shown in FIG. 3*b*. The modified features of FIG. 3*a* will now be described with reference to FIG. 3*b*. For a minimization problem, at 310*a*, a check is made to see if the test value of the automated drilling index (TADI) is smaller than the working value of the automated drilling index (WADI). If TADI is smaller than WADI, then, at 312, the set of working values (WV) is updated with the set of test values (TV), i.e., WV=TV, and the working value of the automated drilling index (WADI) is updated with the test value of the automated drilling index (TADI), i.e., WADI=TADI. At step 314*a*, a check is made to see if the working automated drilling index (WADI) is minimized. If WADI is not minimized, then the processes or steps indicated at 302, 304, 306, 308, 309, 310*a*, 312, and 314*a* are repeated. If during drilling at 316 WADI is not minimized, the processes or steps indicated at 302, 304, 306, 308, 309, 310*a*, 312, and 314*a* may be repeated again.

In one embodiment, automated drilling index of a drilling process is expressed as a sum of a rate of penetration index of the drilling process and a mechanical specific energy index of the drilling process. In one embodiment, automated drilling index, which the automated drilling index generator (148 in FIG. 1) or user or other entity may calculate, has the form:

$$\text{ADI}=(\text{weight_ROP}\times\text{ROPI})+(\text{weight_MSE}\times\text{MSEI}) \quad (1)$$

where $$\text{weight_ROP}+\text{weight_MSE}=1 \quad (2)$$

$$0<\text{weight_ROP}<1 \quad (3)$$

$$0<\text{weight_MSE}<1 \quad (4)$$

In Equation (1), ADI is automated drilling index, ROPI is rate of penetration index, MSEI is mechanical specific energy index, weight_ROP is a user-supplied weight determining the influence of ROPI on ADI, and weight_MSE is a user-supplied weight determining the influence of MSEI on ADI. In an embodiment, weight_ROP and weight_MSE are the same. In another embodiment, weight_ROP and weight_MSE are different. Due to the weights indicated in Equation (1), ADI may be described as a weighted sum of ROPI and MSEI.

In one embodiment, the rate of penetration index is a scaled measure of the rate of penetration of a drilling process. During each application of a set of drilling control variables and assigned values to the drilling of an interval of a borehole, a set of drilling process variables is measured. The rate of penetration of the drilling is determined from the measurement of the set of drilling process variables. The rate of penetration index is then determined from the rate of penetration. In one embodiment, the rate of penetration index has the form:

$$ROPI = 100\times\frac{(ROP-\text{ROP_min})}{(\text{ROP_max}-\text{ROP_min})} \quad (5)$$

where $$\text{ROP_min}\le ROP\le\text{ROP_max} \quad (6)$$

$$\text{ROP_max}>\text{ROP_min} \quad (6a)$$

In Equation (5), ROPI is rate of penetration index, ROP_min is a minimum ROP value, ROP_max is a maximum value. ROP_min and ROP_max are user-supplied and are typically determined from historical drilling parameter data. In Equation (5), ROP_index is 100 when ROP=ROP_max and 0 when ROP=ROP_min. Given any ROP, ROP_index can be determined. The drilling controller (134 in FIG. 1) or a user or other entity separate from the drilling controller may provide a ROP to the automated drilling index generator (148 in FIG. 1) as input. ROP_min and ROP_max may be hardcoded into the automated drilling index generator logic or provided to the automated drilling index generator logic as inputs.

In one embodiment, the mechanical specific energy index is a scaled measure of mechanical specific energy. During each application of a set of drilling control variables and assigned values to the drilling of an interval of a borehole, a set of drilling process variables is measured. The mechanical specific energy of the drilling is determined from the measurement of the set of drilling process variables. The mechanical specific energy index is then determined from the mechanical specific energy. In one embodiment, the mechanical specific energy index has the form:

$$MSEI = 100\times\frac{(MSE-\text{MSE_max})}{(\text{MSE_min}-\text{MSE_max})} \quad (7)$$

where $$\text{MSE_min}\le MSE\le\text{MSE_max} \quad (8)$$

$$\text{MSE_max}>\text{MSE_min} \quad (8a)$$

In Equation (7), MSEI is mechanical specific energy index, MSE_max is a maximum MSE value, and MSE_min is a minimum MSE value. MSE_max and MSE_min are user-supplied and are typically determined from historical drilling parameter data. In Equation (7), MSE_index is 100 when MSE=MSE_min and 0 when MSE=MSE_max. The drilling controller (134 in FIG. 1) or a user or other entity separate from the drilling controller may provide a MSE to the automated drilling index generator (148 in FIG. 1) as input. MSE_min and MSE_max may be hardcoded into the automated drilling index generator logic or provided to the automated drilling index generator logic as inputs.

To calculate MSEI in Equation (7), MSE is needed. The drilling process variables measured by the sensors (132 in FIG. 1) do not include MSE. However, the drilling process variables measured by the sensors can be used to calculate MSE. In an embodiment, MSE is calculated using Teale's definition, or a variation thereof, of specific energy for rock drilling. In an embodiment, MSE is calculated as follows:

$$MSE = E_m \times \left( \frac{4 \times WOB}{\pi \times D^2 \times 1000} + \frac{480 \times N_b \times T}{D^2 \times ROP \times 1000} \right) \tag{9}$$

In Equation (9), MSE psi is mechanical specific energy, $E_m$ is mechanical efficiency, WOB lb is weight on bit, D in is bit diameter, $N_b$ rpm is bit rotational speed, T ft-lb is drill string rotational torque, and ROP ft/hr is rate of penetration. See, Koederitz, William L. and Weis, Jeff, "A Real-Time Implementation of MSE," presented at the AADE 2005 National Technical Conference and Exhibition, held at the Wyndam Greenspoint in Houston, Tex., Apr. 5-7, 2005, AADE-05-NTCE-66. In Equation (9), WOB, D, $N_b$, T, and ROP are drilling parameters that can be measured. $E_m$ may be supplied by a user. The controller logic can calculate MSE or provide the data needed to calculate MSE to the automated drilling index generator (148 in FIG. 1). In the latter case, the automated drilling index generator could calculate MSE as part of calculating MSEI.

In general, automated drilling index is a combination of a rate of penetration index and a mechanical specific energy index. The definitions of the rate of penetration index and the mechanical specific energy index may be as stated above or may be different as long as the rate of penetration index is responsive to changes in rate of penetration and the mechanical specific energy is responsive to changes in mechanical specific energy. Below, some alternative methods for defining the rate of penetration index, the mechanical specific energy, and the automated drilling index are presented.

ROPI as expressed in Equation (5) and MSEI as expressed in Equation (7) will be nonnegative numbers. As such, when they are combined in Equation (1), ADI will also be a nonnegative number. In this case, ADI would have to be maximized to obtain the optimal values of ROP and MSE. However, it is possible to define MSEI and ROPI so that they are negative numbers. In this alternative case, ADI would have to be minimized to obtain the optimal values of ROP and MSE or the absolute value of ADI would have to be maximized to obtain the optimal values of ROP and MSE. Equations (10) and (11) show alternate definitions of ROPI and MSEI, respectively (where $ROPI_1$ means alternate definition of ROPI and $MSEI_1$ means alternate definition of MSEI). Equations (10) and (11) will both yield negative numbers for $ROPI_1$ and $MSEI_1$, assuming Equations (6), (6a), (8), and (8a) remain true.

$$ROPI_1 = 100 \times \frac{(\text{ROP_min} - ROP)}{(\text{ROP_max} - \text{ROP_min})} \tag{10}$$

$$MSEI_1 = 100 \times \frac{(\text{MSE_max} - MSE)}{(\text{MSE_min} - \text{MSE_max})} \tag{11}$$

Another way to transform the optimization of ADI into a minimization problem is to define ROPI such that it is inversely proportional to ROP and to define MSEI such that it is inversely proportional to MSE, or to express ADI as shown below (where $ADI_1$ simply represents an alternate definition of ADI):

$$ADI_1 = \frac{1}{(\text{weight_ROP} \times ROPI)} + \frac{1}{(\text{weight_MSE} \times MSEI)} \tag{12}$$

where ROPI and MSEI are given by Equations (5) and (7).

Equations (13) and (14) show other examples of definitions for ROPI and MSEI, respectively, assuming Equations (6), (6a), (8), and (8a) remain true.

$$ROPI_2 = 100 \times \frac{(ROP^{\mu} - \text{ROP_min}^{\mu})}{(\text{ROP_max}^{\mu} - \text{ROP_min}^{\mu})} \tag{13}$$

where $$\mu \geq 1 \tag{13a}$$

$$MSEI_2 = 100 \times \frac{(MSE^{v} - \text{MSE_max}^{v})}{(\text{MSE_min}^{v} - \text{MSE_max}^{v})} \tag{14}$$

where $$v \geq 1 \tag{14a}$$

In Equations (13) and (14), $ROPI_2$ represents alternate definition of ROPI and $MSEI_2$ represents alternate definition of MSEI. In these equations, μ and v may be real numbers or integers, may function as weights, and may replace weight_ROP and weight_MSE in Equation (1). That is, ADI may be rewritten as follows (where $ADI_2$ simply represents an alternate definition of ADI):

$$ADI_2 = ROPI_2 + MSEI_2 \tag{15}$$

where $ROPI_2$ and $MSEI_2$ are given by Equations (13) and (14).

Returning to the basic maximization example, from the expressions for ROPI and MSEI in Equations (5) and (7) above, it is clear that ADI in Equation (1) ultimately depends on ROP and MSE. However, note that ADI is not a simple sum of ROP and MSE. Rather ADI is a combination of an index that depends on ROP and an index that depends on MSE, the indices yielding dimensionless numbers when evaluated for a specific value of ROP and MSE, respectively. From Equations (1), (5), and (7), it can be seen that ADI has an upper limit of 100 and a lower limit of 0. Thus in an embodiment, when maximizing ADI, the goal would be to bring ADI as close as possible to 100. It is of course possible to define ROPI and MSEI differently so that the upper limit for ADI is not 100. For example, number 100 in Equations (5) and (7) could be easily replaced with any other scalar value, which would then determine the upper limit for ADI. For example, if the number 100 in Equations (5) and (7) is replaced with 200, then the upper limit for ADI would be 200. There may be other ways of defining ROPI and MSEI so that they provide a scaled measure of ROP and MSE, respectively. ROPI and MSEI simply locate ROP and MSE, respectively, on a scale of a lower scale limit to an upper scale limit. In Equations (5) and (7), the lower scale limit is 0 and the upper scale limit is 100. Notice that ROPI and MSEI are simply numbers and can be simply added whereas ROP and MSE are properties with different units and cannot be simply added.

The automated drilling index (ADI), as defined in, for example, Equation (1), provides an objective that can be optimized during a drilling operation. The optimization of the automated drilling index will drive the drilling process, as explained above. In an embodiment, it is desired to maximize automated drilling index in order to achieve the best trade-off between ROP and MSE for the drilling process. By maximizing automated drilling index, as defined in Equation (1), for example, MSE can be minimized while ROP is maximized. It is noted that an objective based on a simple addition of ROP to MSE would not yield desired results because MSE and ROP are oppositely oriented, i.e., the preferred state is low MSE and high ROP, and express different properties. In contrast to the simple addition objective, the ADI objective sums ROPI and MSEI, which are both normalized and both positively contribute to the value of ADI. As a result, ROP and MSE are optimized as ADI is optimized. A user has an opportunity to specify which of ROP and MSE to most favor in the optimization via the use of weights. See, for example, Equation (1). This has practical applications. As an example, when a new bit has a short distance to drill, a higher ROP at the expense of increased MSE may be preferred for economic reasons. In this case, the user-supplied weights can be such that ROP is more favored in the optimization of ADI. Although the above has been described with respect to maximization of ADI, it should be noted that optimization may be cast as a minimization problem as well, where MSE will be minimized and ROP will be maximized as ADI is minimized.

Table 1 below shows values of drilling process variables (WOB, $N_b$, MSE, ROP) and corresponding values of ADI, ROPI, and MSEI. Equations (1), (5), and (7) are used for computation of these indices. In computation of ADI of Table 1, equal weights of 0.5 each were applied to ROPI and MSEI. Also, MSE_min=262.601, MSE_max=950.837, ROP_min=3.023, and ROP_max=15.537. In Table 1, the highest value for ADI is 99.6, with ROPI being 100 and MSEI being 99.2. At MSEI of 99.2, MSE is 268.415, which is very close to MSE_min. Therefore, both ROP and MSE are optimized by selecting the highest value for ADI. The example shown in Table 1 is intended for illustration purposes only and is not to be construed as limiting the invention as otherwise described in this specification.

TABLE 1

| No. | WOB lbs | $N_b$ rpm | MSE Kpsi | ROP ft/hr | MSEI | ROPI | ADI |
|---|---|---|---|---|---|---|---|
| 1 | 10 | 72 | 950.837 | 3.023 | 0.0 | 0.0 | 0 |
| 2 | 10 | 88 | 527.851 | 6.551 | 61.5 | 28.2 | 44.85 |
| 3 | 10 | 102 | 464.453 | 8.921 | 70.7 | 47.1 | 58.9 |
| 4 | 20 | 72 | 444.316 | 7.746 | 73.6 | 37.7 | 55.65 |
| 5 | 20 | 88 | 317.154 | 12.164 | 92.1 | 73.0 | 82.55 |
| 6 | 20 | 102 | 489.911 | 8.662 | 67.0 | 45.1 | 56.05 |
| 7 | 30 | 72 | 262.601 | 14.006 | 100.0 | 87.8 | 93.9 |
| 8 | 30 | 88 | 268.415 | 15.537 | 99.2 | 100.0 | 99.6 |
| 9 | 30 | 102 | 528.311 | 9.805 | 61.4 | 54.2 | 57.8 |
| 10 | 27 | 68 | 483.332 | 6.224 | 67.9 | 25.6 | 46.75 |
| 11 | 27 | 72 | 425.955 | 8.629 | 76.3 | 44.8 | 60.55 |
| 12 | 27 | 78 | 602.168 | 8.676 | 50.7 | 45.2 | 47.95 |
| 13 | 30 | 68 | 401.206 | 7.728 | 79.9 | 37.6 | 58.75 |
| 14 | 30 | 72 | 398.287 | 9.241 | 80.3 | 49.7 | 65 |
| 15 | 30 | 78 | 856.935 | 6.501 | 13.6 | 27.8 | 20.7 |
| 16 | 33 | 68 | 331.359 | 9.582 | 90.0 | 52.4 | 71.2 |
| 17 | 33 | 72 | 463.733 | 8.329 | 70.8 | 42.4 | 56.6 |
| 18 | 33 | 78 | 725.416 | 8.339 | 32.8 | 42.5 | 37.65 |
| 19 | 33 | 66 | 451.839 | 7.265 | 72.5 | 33.9 | 53.2 |
| 20 | 33 | 69 | 312.539 | 10.685 | 92.7 | 61.2 | 76.95 |

Figure 4:
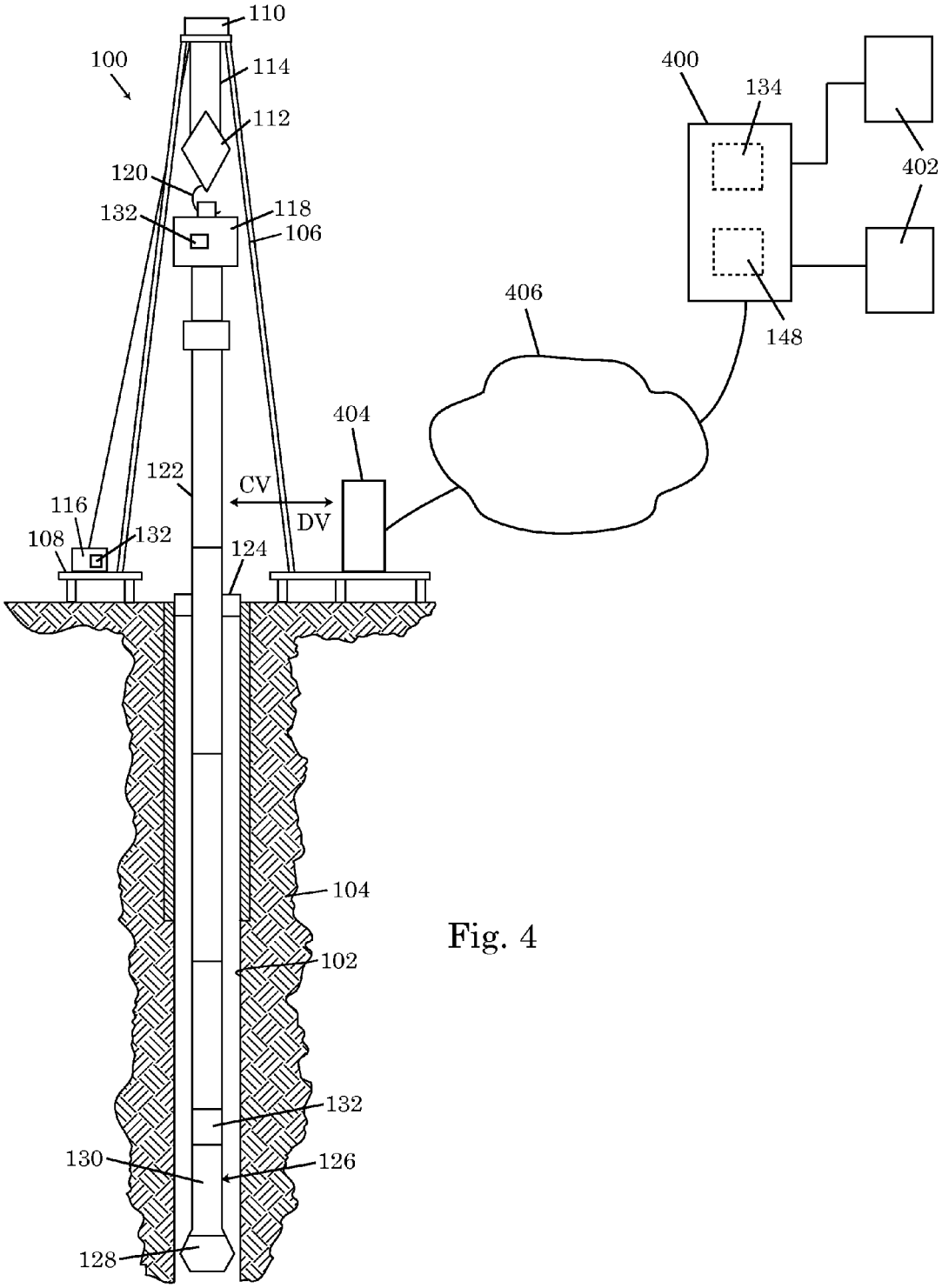
FIG. 4 is a schematic of an apparatus for automated drilling of a borehole in a subsurface formation, with a portion of the apparatus being remote from the drilling site.

In FIG. 1, the drilling controller 134 and automated drilling index generator 148 are shown at the drilling site. However, it is possible to have either or both of the drilling controller 134 and the automated drilling index generator 148 at a location remote from the drilling site, with appropriate infrastructure provided to enable communication between the drilling controller 134 and desired components of the automated drilling apparatus 100. In one example, as illustrated in FIG. 4, the logic of the drilling controller 134 and the logic of the automated drilling index generator 148 are loaded onto a server 400 at a remote site. Analysts at the remote site can interact with the drilling controller 134 and automated drilling index generator 148 via computers 402 connected, e.g., via a local area network or wide area network or world wide web, to the server 400. A client 404 can be provided at the drilling site. The client 404 can receive signals from components, e.g., sensors, of the automated drilling apparatus 100 and can transmit signals to components, e.g., components requiring controller set-points, of the automated drilling apparatus 100. The client 404 communicates with the server 400 over a network 406, e.g., the world wide web. Through the network 406, the logic of the drilling controller 134 can transmit set-points to the client 404, which the client 404 will provide to components of the automated drilling apparatus 100. Also, through the network 406, the logic of the drilling controller 134 can receive measurement data from the client 404, which the client 404 will obtain from components of the automated drilling apparatus 100. In a modification of FIG. 4, the drilling controller 134 may take the place of the client 404, with the logic of the automated drilling index generator 148 still on the server 400. The drilling controller 134 could then communicate with the automated drilling index generator 148 via the network 406. The logic of the drilling controller 134 and the automated drilling index generator 148 may be provided as tangible products on computer-readable media. The logic on the computer-readable media, when executed, will perform automated drilling of a borehole, as described above.

It will be appreciated by those skilled in the art that the systems/techniques disclosed above can be fully automated/autonomous via software configured with algorithms to perform operations as described herein. These aspects can be implemented by programming one or more suitable general-purpose computers having appropriate hardware. The programming may be accomplished through the use of one or more program storage devices (e.g., 146 in FIG. 1) readable by the processor(s) and encoding one or more programs of instructions executable by the computer for performing the operations described herein. The program storage device may take the form of, e.g., one or more floppy disks; a CD ROM or other optical disk; a magnetic tape; a read-only memory chip (ROM); and other forms of the kind well-known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described computing/automation functions downhole (via appropriate hardware/software implemented in the network/string), at surface, in combination, and/or remotely via wireless links tied to the network.

While the invention has been described with respect to a limited number of embodiments, those skilled in the art, having benefit of this disclosure, will appreciate that other embodiments can be devised which do not depart from the scope of the invention as disclosed herein. Therefore, it is intended that the invention cover the modifications and variations of this invention provided they come within the scope of the appended claims and their equivalents. It is intended that the scope of differing terms or phrases in the claims may be fulfilled by the same or different structure(s) or step(s).

What is claimed is:

1. A method for automated drilling of a borehole in a subsurface formation, comprising:

(a) drilling the borehole using a set of drilling control variables assigned a set of values;

(b) monitoring an automated drilling index of the drilling of step (a), the automated drilling index of the drilling of step (a) being a combination of a first index dependent on a rate of penetration of the drilling of step (a) and a second index dependent on a mechanical specific energy of the drilling of step (a); and having the form:

$$ADI=(weight_ROP\times ROPI)+(weight_MSE\times MSEI),$$

where ADI is the automated drilling index, ROPI is the first index dependent on rate of penetration, MSEI is second index dependent on the mechanical specific energy, and weight_ROP and weight_MSE are weights; and (c) selectively adjusting the set of values of step (a) at least once during step (a) based on the monitoring of step (b).

2. The method of claim 1, wherein step (b) comprises:

(b1) determining at least two values of the automated drilling index corresponding to at least two segments of the drilling of step (a).

3. The method of claim 2, wherein step (c) comprises:

(c1) selectively adjusting the selected values of step (a) based on a comparison between the at least two values of the automated drilling index.

4. The method of claim 1, wherein in step (b), the first index and the second index are equally weighted in the sum.

5. The method of claim 1, wherein in step (b), the first index and the second index are differently weighted in the sum.

6. The method of claim 1, further comprising:

(d) measuring a set of drilling process variables during step (a).

7. The method of claim 6, wherein step (b) comprises:

(b4) deducing the rate of penetration and the mechanical specific energy of the drilling of step (a) from the measuring of step (d).

8. The method of claim 6, wherein the set of drilling process variables comprises at least one drilling process variable selected from the group consisting of weight on bit, bit rotational speed, drill string rotational torque, rate of penetration, and bit diameter.

9. The method of claim 6, wherein the set of drilling control variables comprises at least one drilling control variable selected from the group consisting of weight on bit, bit rotational speed, drill string rotational torque, rate of penetration, and bit diameter.

10. A method for automated drilling of a borehole in a subsurface formation, comprising:

(a) defining an automated drilling index as:

$$ADI=(weight_ROP\times ROPI)+(weight_MSE\times MSEI),$$

where ADI is the automated drilling index, ROPI is the rate of penetration index, MSEI is the mechanical specific energy index, and weight_ROP and weight_MSE are weights;

(b) defining a set of drilling control variables;

(c) selecting a set of first values for the set of drilling control variables;

(d) assigning the set of first values to the set of drilling control variables;

(e) drilling through one interval of the borehole using the set of drilling control variables assigned the set of first values;

(f) determining a first value of the automated drilling index corresponding to the drilling of step (e);

(g) assigning a set of second values to the set of drilling control variables;

(h) drilling through another interval of the borehole using the set of drilling control variables assigned the set of second values;

(i) determining a second value of the automated drilling index corresponding to the drilling of step (h);

(j) assigning a set of third values to the set of drilling control variables based on a comparison between the first value of the automated drilling index and the second value of the automated drilling index; and (k) updating the set of first values with the set of third values and repeating step (d).

11. The method of claim 10, wherein in step (j), the set of third values is selected from the set of second values used in step (h) and the set of first values used in step (e).

12. The method of claim 11, further comprising:

(l) repeating steps (d) through (k).

13. The method of claim 12, wherein in step (a), the automated drilling index has a predefined upper limit, and further comprising:

(m) repeating step (l) until the first automated drilling index is within a range from 80% to 100% of the predefined upper limit.

14. The method of claim 12, wherein in step (a), the automated drilling index has a predefined lower limit, and further comprising:

(n) repeating step (l) until the first automated drilling index is within a range from 100% to 120% of the predefined lower limit.

15. The method of claim 14, wherein the set of drilling control variables comprises at least one drilling control variable selected from the group consisting of weight on bit, bit rotational speed, drill string rotational torque, rate of penetration, and bit diameter.

16. The method of claim 10, wherein the rate of penetration index of step (a) has the form:

$$ROPI = 100\times\frac{(ROP - \text{ROP_min})}{(\text{ROP_max} - \text{ROP_min})}$$

where ROPI is the rate of penetration index, ROP is the rate of penetration, ROP_min is a minimum rate of penetration, and ROP_max is a maximum rate of penetration.

17. The method of claim 16, wherein the mechanical specific energy of step (a) has the form:

$$MSEI = 100\times\frac{(MSE - \text{MSE_max})}{(\text{MSE_min} - \text{MSE_max})}$$

where MSEI is the mechanical specific energy index, MSE is the mechanical specific energy, MSE_min is a minimum mechanical specific energy, and MSE_max is a maximum mechanical specific energy.

18. The method of claim 17, further comprising:

(o) measuring a set of drilling process variables during step (e); and (p) measuring the set of drilling process variables during step (h).

19. The method of claim 18, wherein step (f) comprises determining the first value of the automated drilling index from the measuring of step (o) and step (i) comprises determining the second value of the automated drilling index from the measuring of step (p).

20. The method of claim 19, wherein the set of drilling process variables comprises at least one drilling process variable selected from the group consisting of weight on bit, bit rotational speed, drill string rotational torque, rate of penetration, and bit diameter.

21. A program product comprising a non-transitory computer-readable media having recorded thereon computer-executable instructions for automated drilling of a borehole in a subsurface formation, the computer-executable instructions performing the following steps:

(a) controlling drilling of a first interval of the borehole using a set of drilling control variables assigned a set of first values;

(b) determining a first value of an automated drilling index corresponding to drilling of the first interval of the borehole, the automated drilling index having the form:

$$ADI=(weight_ROP\times ROPI)+(weight_MSE\times MSEI),$$

where ADI is the automated drilling index, ROPI is the rate of penetration index, MSEI is the mechanical specific energy index, and weight_ROP and weight_MSE are weights;

(c) controlling drilling of a second interval of the borehole using the set of drilling control variables assigned a set of second values;

(d) determining a second value of the automated drilling index corresponding to the drilling of the second interval of the borehole; and (e) controlling drilling of a third interval of the borehole using the set of drilling control variables assigned a set of third values selected based on a comparison between the first and second values of the automated drilling index.

22. A program product comprising a non-transitory computer-readable media having recorded thereon computer-executable instructions for automated drilling of a borehole in a subsurface formation, the computer-executable instructions performing the following steps:

(a) outputting a set of drilling control variables assigned a set of first values to a drilling apparatus adapted to drill the borehole in the subsurface formation;

(b) determining a first value of an automated drilling index based on a first drilling process variable measurement made during drilling of the borehole using the set of drilling control variables assigned the set of first values, the automated drilling index having the form:

$$ADI=(weight_ROP\times ROPI)+(weight_MSE\times MSEI)$$

where ADI is the automated drilling index, ROPI is the rate of penetration index, MSEI is the mechanical specific energy index, and weight_ROP and weight_MSE are weights;

(c) outputting the set of drilling control variables assigned a set of second values to the drilling apparatus;

(d) determining a second value of the automated drilling index based on a second drilling process variable measurement made during drilling of the borehole using the set of drilling control variables assigned the set of second values; and (e) assigning a set of third values to the set of drilling control variables based on a comparison between the first and second values of the automated drilling index and outputting the set of drilling control variables assigned the set of third values to the drilling apparatus.

23. An apparatus for automated drilling of a borehole in a subsurface formation, comprising:

means for drilling the borehole using a set of drilling control variables assigned a set of values;

means for measuring a set of drilling process variables during drilling of the borehole;

means for determining an automated drilling index of the drilling of the borehole from the measuring of the set of drilling process variables, the automated drilling index having the form:

$$ADI=(weight_ROP\times ROPI)+(weight_MSE\times MSEI),$$

where ADI is the automated drilling index, ROPI is the rate of penetration index, MSEI is the mechanical specific energy index, and weight_ROP and weight_MSE are weights; and means for comparing different values of the automated drilling index and adjusting the set of values assigned to the set of drilling control variables used in the drilling of the borehole based on a result of the comparing.

* * * * *